US005520132A

United States Patent [19]

Crippen

[11] Patent Number: 5,520,132

[45] Date of Patent: May 28, 1996

[54] CONTAINMENT INTEGRITY SYSTEM FOR VESSELS

[76] Inventor: W. Stuart Crippen, 84 Lincoln Ave., Winchendon, Me. 01475

[21] Appl. No.: 405,409

[22] Filed: Mar. 15, 1995

Related U.S. Application Data

[63] Continuation-in-part of Ser. No. 130,755, Oct. 4, 1993, abandoned, which is a continuation-in-part of Ser. No. 658,601, Feb. 21, 1991, abandoned.

[51] Int. Cl.[6] ..... B63B 25/08

[52] U.S. Cl. ..... 114/74 R; 114/72

[58] Field of Search ..... 114/72, 74 A, 114/74 R; 137/68.1, 71, 614; 220/461, 470, 900, 403, 410, 413, 5 A, 901, 1 B

[56] References Cited

U.S. PATENT DOCUMENTS 3,043,542 7/1962 Neushotz ..... 137/68.1
4,117,796 10/1978 Strain ..... 114/74 R
5,031,558 7/1991 Davis ..... 114/74 R

FOREIGN PATENT DOCUMENTS 4113985 4/1992 Japan ..... 114/74 R

*Primary Examiner*—Edwin L. Swinehart
*Attorney, Agent, or Firm*—Walter G. Finch; Nancy A. Smith

[57] ABSTRACT

The present invention provides a containment integrity system for application in a vessel carrying bulk materials such as liquid petroleum products. The containment integrity system comprises a flexible liner having an inner composite fabric portion and an outer fiber-reinforced rubber skin portion, a fastening system for rigidly securing the flexible liner to the walls of the vessel, an anchoring system for releasably securing and conforming the flexible liner to and about all coverable features of the hull of the vessel, and a self-sealing flange assembly for insertion into all flow holes connecting the cargo compartments of the vessel. The present containment integrity system insures the necessary containment integrity of the hull of the vessel without significant reduction in the carrying capacity of the vessel.

20 Claims, 7 Drawing Sheets

CONTAINMENT INTEGRITY SYSTEM FOR VESSELS

This application is a continuation-in-part of my earlier application entitled CONTAINMENT INTEGRITY SYSTEM FOR VESSELS FOR USE IN TRANSPORTATION OF PETROLEUM PRODUCTS, filed Oct. 4, 1993, Ser. No. 08/130,755, which is a continuation-in-part of an application filed on Feb. 21, 1991 and assigned Ser. No. 07/658,601, both now abandoned.

BACKGROUND OF THE INVENTION

This invention relates to storage devices for fluids or other materials being transported, and more particularly, to a containment integrity system for vessels used in the transportation of petroleum products.

PRIOR ART

The best known prior U.S. art is as follows:

U.S. Pat. No. 3,844,239

U.S. Pat. No. 3,949,894

Polymeric materials possess a number of qualities which have rendered them useful as coatings on vessels or containers carrying liquids. These qualities include high levels of tensile strength, pliability, and kinetic energy absorption. In his U.S. Pat. No. 3,949,894, Underwood discloses a container suitable for containing high temperature lubricating Oil. The Underwood container is coated with a multiple layer laminate including a first lamina of a rubbery polyfluorohydrocarbon composition, a second lamina of a number of layers of a textile woven fabric selected from aromatic polyamides and polyaramides coated with a flexible polyfluorocarbon composition, and optionally, a third rigid lamina of polymer-encapsulated glass fibers. The Underwood invention is intended to preserve the integrity of the container carrying the lubricating oil if and when the laminate covered container is punctured with a projectile.

The U.S. Pat. No. 3,844,239 issued to McLaughlin et al teaches a liquid bulk carrying ship designed to withstand a puncture in the hull of the ship while spilling only a minimal amount of its contents into the surrounding sea. The McLaughlin et al ship has a number of reservoirs each coated with an impermeable, elastomeric lining which is releasably attached to the inner walls of the reservoirs. The elastomeric lining, formed from either two or three layers of appropriate polymer combinations, is able to withstand the force of impact of a protruding object without tearing as it is free to separate from the reservoir walls upon the application of a sufficient external force.

STATEMENT OF THE PROBLEM

The petroleum industry is plagued with the problem of spillage of its petroleum products from transport vessels into environments where the products are neither wanted nor needed. Too often, tremendous loss of plant and animal life results from the spillage of these hazardous petroleum products. While concern for the ecological damage produced by these spills has continued to increase as time has passed, the Exxon Valdeze accident off of the coast of Alaska was the incident that led concern for these environmental disasters to a record high.

Shortly after the Valdeze accident, a number of oil spills occurred off of the coast of California. One of those spills resulted when an oil tanker, one of Exxon's, punctured its own hull with its anchor.

Shortly after this incident, the news media began to report a movement by certain environmental groups and Californian politicians to push oil companies to "double hull" their tankers as a means to minimize oil spills. This process, however, is a very costly one, both in terms of the expense associated with implementing this on existing ships or incorporating it in new ships and in the loss of volume that such a procedure would incur to these same vessels.

SUMMARY OF THE INVENTION

The present invention provides a novel liner for the hull of a transport ship carrying bulk materials. The most significant component of the liner is a number of layers of woven fibers of a polymeric material sold by Du Pont under the trademark KEVLAR, which currently is used as a major component in the body armor used by military and law enforcement agencies.

The KEVLAR fibers which are woven together to form the layers of the liner are also known as Poly (terephthaloylchloride) p-phenylenediamine. This polymeric fiber has been engineered to possess extremely high tensile strength, approximately five times that of an equivalent strand of steel. The fabrics that result from weaving these fiber strands are extremely resistant to puncture, can absorb great amounts of kinetic energy, and exhibit strengths approximately six times that of equivalent thicknesses of steel plates while remaining flexible and pliable.

The composite fabric is encased in a chemically resistant, synthetic rubber skin to provide a surface that is easier to handle and maintain in the form of a liner. The liner is then configured into sheets that are attached to the vessel via a fastener system and held in place at corners, curves, and other topographic features via a system of fastener strips attached to the vessel wall and tear-away tabs attached to one side of the liner's outer skin. In operation, the liner provides a fluid, air, and petroleum tight barrier between the contents and the hull of the vessel.

In situations where it is necessary to provide a barrier in between two or more adjacent compartments while maintaining the ability of the material in one compartment to flow, mix, or be in contact with material in the other compartment(s), a self-sealing flange assembly is provided. When the flange joint is sufficiently stressed as in the case of a hull rupture, the flange assembly has the ability to self-plug via gas bag seals in order to insure containment integrity within the respective compartments.

While this specification has been directed to a containment integrity system for vessels used in the transportation of petroleum products by the petroleum industry, it will be appreciated that this invention need not be limited to the vessels and products specific to the aforestated application. Said vessels and products are only specific configurations of generic items. It is, therefore, possible to extrapolate the application of this invention to said generic items as well. All other potential applications should apply to this invention.

OBJECTS OF THE INVENTION

It is a principal object of this invention to provide a new and innovative system for the petroleum industry to combat undesirable spillage of petroleum products.

Still another object of this invention is .to provide a containment integrity system for vessels used in the transportation of petroleum type products.

A further object of this invention is to provide a containment integrity system for vessels used in the transportation of petroleum type products that utilizes a novel configuration of materials in the construction thereof.

To provide a unique containment integrity system for vessels used in the transportation of petroleum type products which uses a simplified and efficient fastener and anchoring system for securing a protective liner to the hull and other structural members of the vessel is another object of this invention.

To provide a novel containment integrity system for vessels used in the transportation of bulk materials which incorporates self-sealing flange assemblies in the flow holes separating different compartments is still another object of this invention.

And to provide a novel containment integrity system for vessels used in the transportation of petroleum type products which is economical in cost, efficient and reliable in operational use, and easy to install is yet another object of this invention.

BRIEF DESCRIPTION OF THE DRAWINGS

These and other attendant advantages of this invention will become more obvious and apparent from the following detailed specification and accompanying drawings in which.

DESCRIPTION OF THE PREFERRED EMBODIMENTS OF THE INVENTION

Figure 1:
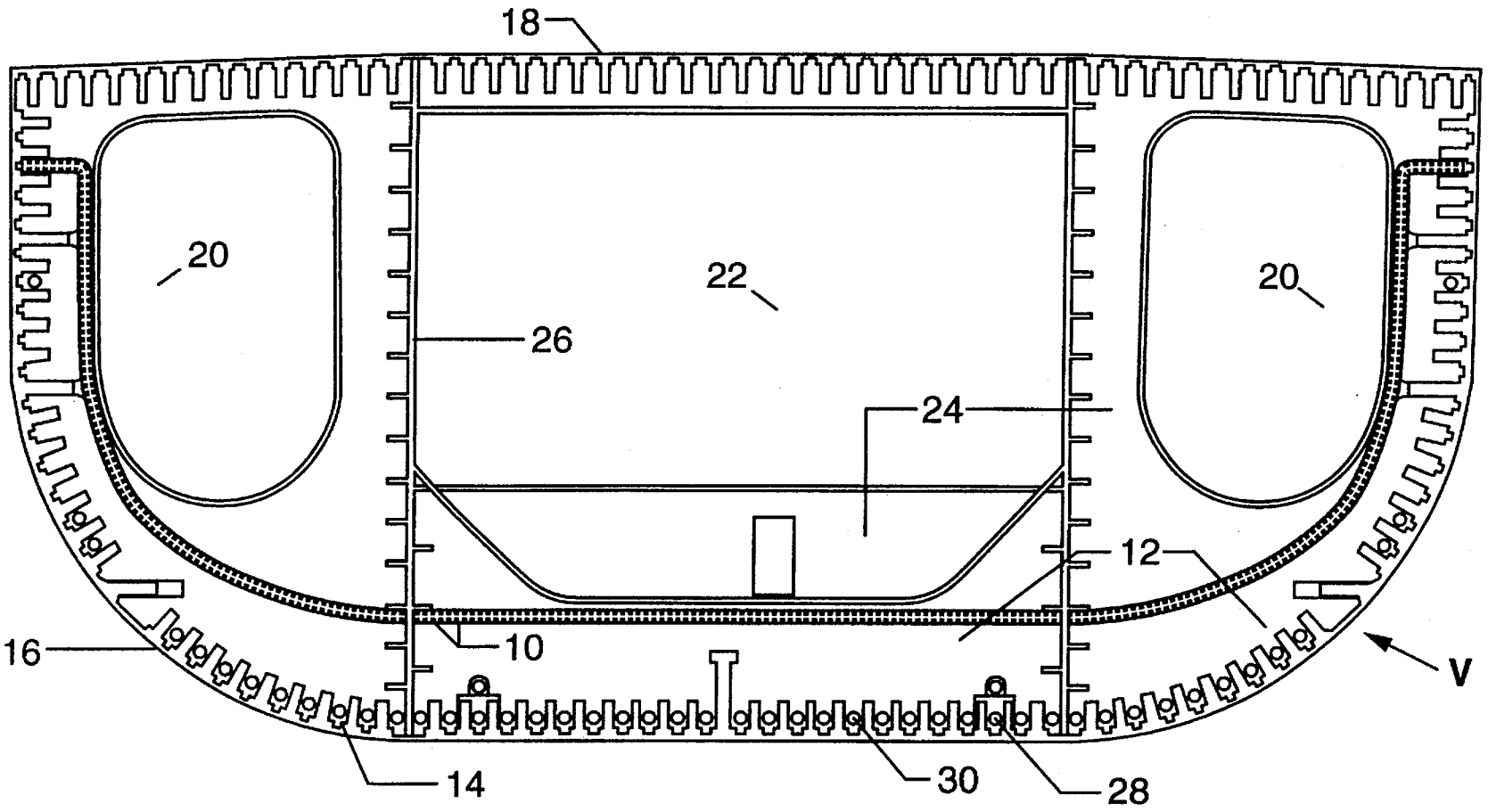
FIG. 1 is a cross section through a sea transport vessel illustrating the application of a containment integrity system within different cargo compartments of the vessel, the figure incorporating novel features of this invention and showing the preferred embodiment thereof.

Referring now to FIGS. 1 to 9 of the drawings, there is shown the preferred embodiment of the containment integrity system for a vessel V used in the transportation of petroleum products, such as oil. The vessel V consists primarily of an arcuate hull 16, an upper deck section 18, and a number of transverse bulkheads 24 and longitudinal bulkheads 26. The transverse and longitudinal bulkheads 24 and 26, which serve as the primary structural members of the vessel V, intersect each other to form a number of wing cargo tanks 20 and center cargo tanks 22. The section of the vessel V illustrated in FIG. 1 happens to show two wing cargo tanks 20 and one center cargo tank 22, although it will be appreciated that many different combinations and arrangements thereof are possible. As illustrated in FIG. 1, the containment integrity system includes a flexible liner 12 which covers the lower and side sections of the cargo tanks 20 and 22. It will be noted that the sections of the cargo tanks 20 and 22 which the liner 12 covers are those where the hull 16 is the most susceptible to puncture by an external object. The flexible liner 12 is rigidly secured to the bulkheads 24 and 26 of the vessel V via a fastener system 10, and detachably anchored to conform to the contours of the internal features of the vessel V (i.e., the rib projections off of the hull 16) by means of an anchoring system 14.

Also seen in FIG. 1 are a number of flow holes 30 which have each been fitted with a self-sealing flange assembly. These flow holes 30 allow the contents of the vessel V to circulate from compartment to compartment, and are therefore instrumental in filling and emptying the liquid petroleum contents of the vessel V. A number of holes 28 are not joined to the liquid petroleum supply, and therefore are not fitted with the self-sealing flange assemblies.

If in fact a vessel V were double hulled, an additional layer of steel plate would be welded over top of the rib projections of the hull 16. This would cause a significant reduction in carrying capacity of the: vessel V, the amount of capacity lost equivalent to the volume of open rib space contained in between the additional steel plate and the primary hull 16.

By contrast, the flexible liner 12 of the present invention is positioned on the inner surface of the hull 16, and in juxtaposition thereto. The liner 12 is of sufficient thickness and composition to provide the necessary protection against leakage of petroleum products in the event of a puncture of the hull 16 of the vessel V, or other condition leading to the loss of containment integrity of the vessel V. The liner 12 consists of layers of material woven from fabric strands, the material having been specifically engineered to provide the attributes necessary to prevent penetration of foreign objects therethrough. The material of the liner 12 is pliable and capable of conforming itself to the topography of the hull 16 of the vessel V in which it is installed to a limit necessary to maintain low stress levels in the material.

The most significant component of the: liner 12 is a number of layers of woven fibers of a polymeric material sold by Du Pont under the trademark KEVLAR, which currently is used as a major component in the body armor used by military and law enforcement agencies. These KEVLAR fibers are also known as Poly (terephthaloylchloride) p-phenylenediamine. This polymeric fiber has been engineered to possess extremely high tensile strength, approximately five times that of an equivalent strand of steel. The fabrics that result from weaving these fiber strands are extremely resistant to puncture, can absorb great amounts of kinetic energy, and exhibit strengths approximately six times that of equivalent thicknesses of steel plates. Additionally, the fabrics which form the liner 12 remain flexible and pliable.

The KEVLAR material is made up of the following materials per Du Pont's Material Safety Data Sheet: (All information regarding the specific combination or application of the materials is proprietary of Du Pont, and, as such, is unavailable to author and is thus not subject to the scope of this invention.)

| | | |
|---|---|---|
| Poly (terephthaloylchloride) p-phenylenediamine | CAS #26125-61-1 | >89% |
| Water, absorbed | CAS #7732-18-5 | < or = 7% |
| Sodium Sulfate | CAS #7757-82-6 | <2% |
| Finish | none | <2% |
| Wax Overlay | CAS #6474-43-4 | <10% |

Figure 2:
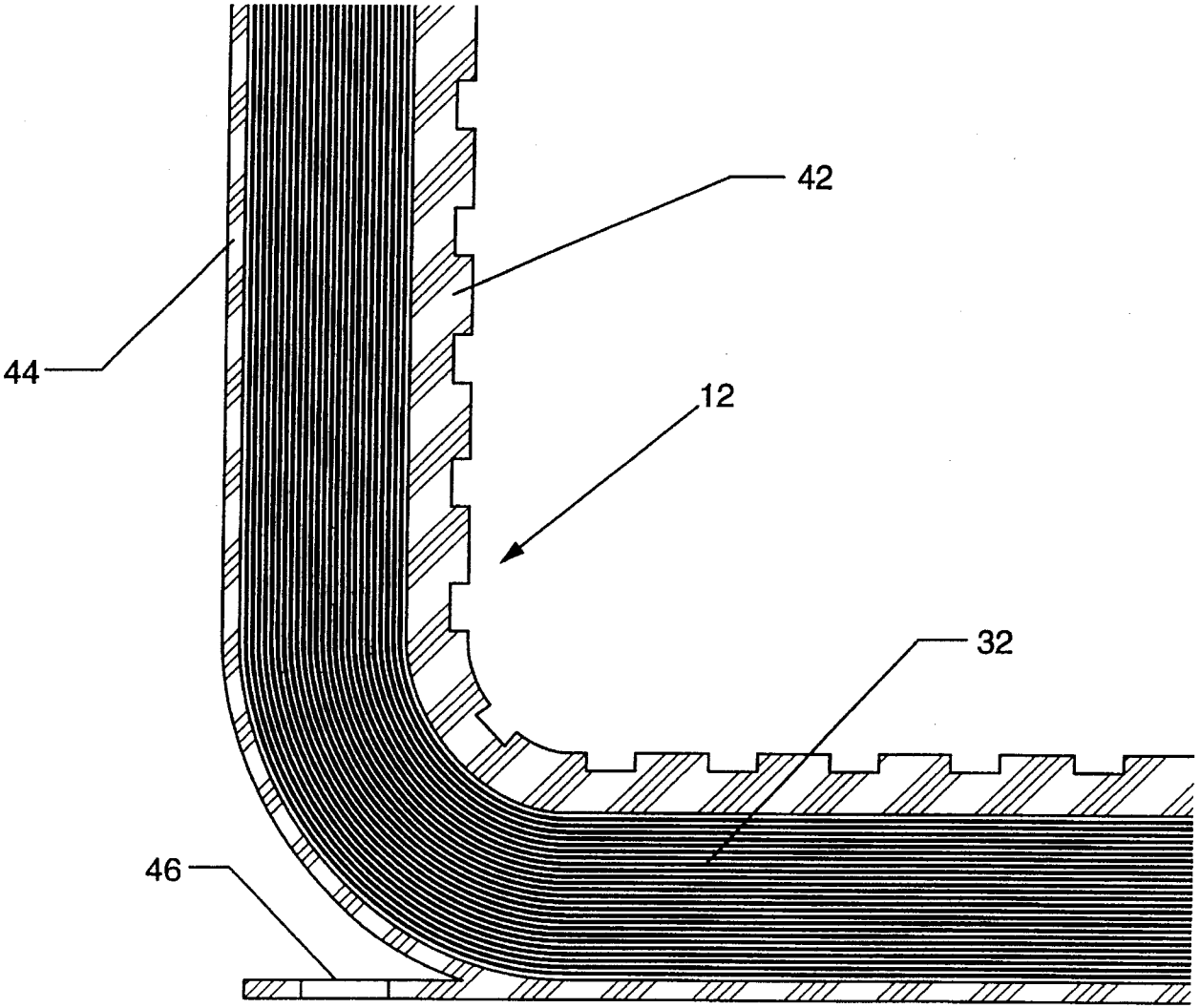
FIG. 2 is a section view, much enlarged, through a portion of the liner of the containment integrity system of FIG. 1.

FIG. 2 illustrates a section through a portion of the flexible liner 12. The inner liner portion 32 is constructed from a number of layers of fabrics woven from the KEVLAR fibers. This inner liner portion 32 is therefore a composite fabric which provides the majority of the puncture resistant strength associated with the liner 12. The inner liner portion 32 is encased in a chemically resistant, synthetic rubber skin having an impermeable top side layer 42 and an impermeable bottom side layer 44. The top side layer 42 of the liner 12 is constructed from a textured synthetic rubber reinforced with KEVLAR strands. The bottom side layer 44 of the liner 12 is constructed from a smooth synthetic rubber and is also reinforced with KEVLAR strands. Integral with the bottom side layer 44 are a number of tear-away tabs 46 constructed from smooth synthetic rubber without reinforcing strands. These tear-away tabs 46 have apertures in their lengths to facilitate anchoring of the liner 12 to the hull 16 of the vessel V, the entire discussion of which is given in detail in the context of FIG. 8.

Figure 3:
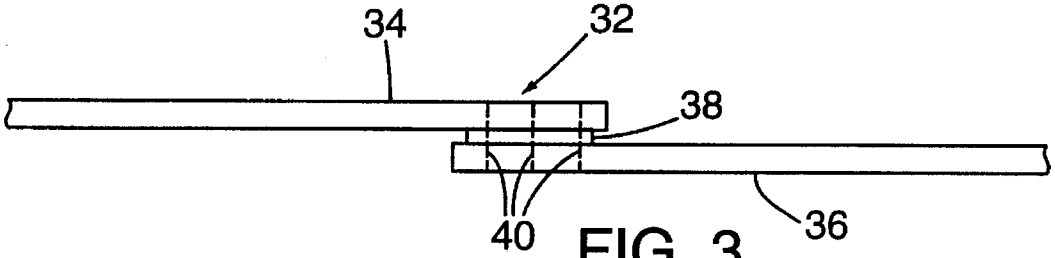
FIG. 3 is a side view of one layer of the liner of FIG. 2, showing how two individual plies are joined together by epoxy adhesive and stitching.
Figure 4:
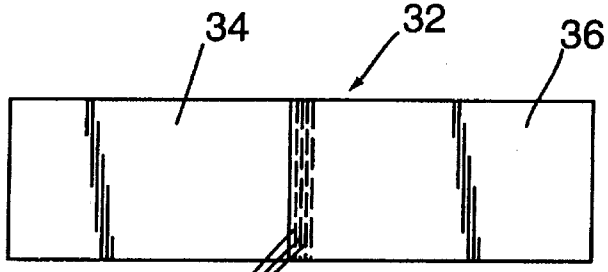
FIGS. 4 and 5 are top views of the liner layer of FIG. 3, the latter being enlarged to further illustrate the stitching of the plies.
Figure 5:
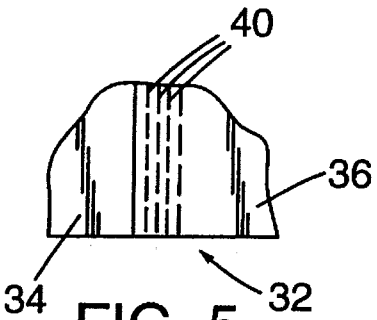
Figure 6:
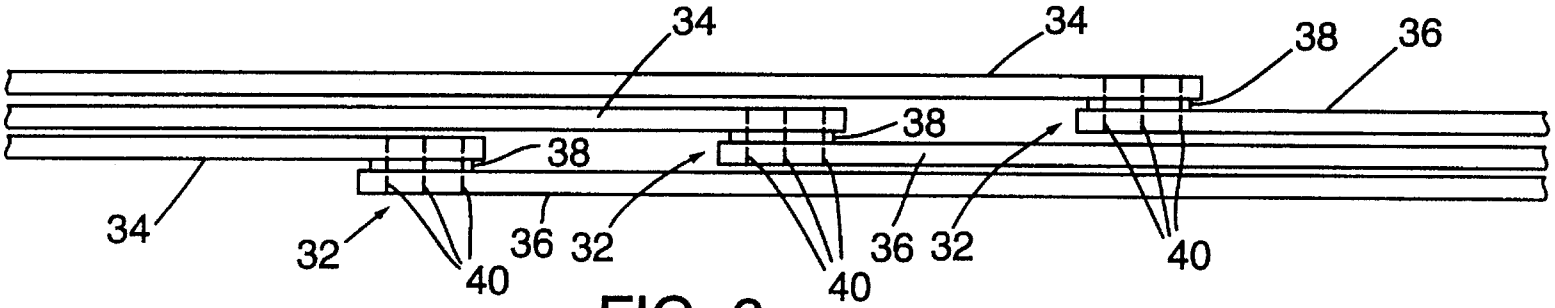
FIG. 6 is a side view of a combination of three layers which have been joined to form the interior of a liner such as that illustrated in FIG. 2.

The construction of the inner liner portion 32 may be more clearly understood by referring to FIGS. 3 through 6. As seen in FIG. 3, a single layer of the inner liner portion 32 forming the composite fabric consists of two plies 34 and 36 of the fabric woven from the KEVLAR fibers which are joined together via epoxy adhesive 38 and stitching 40. The two plies 34 and 36 are overlapped at least twelve inches. FIGS. 4 and 5 show top views of one such layer. FIG. 6 shows how numerous layers are laid upon one another, with seam joints staggered at least twenty-four inches, to form the inner liner portion 32 or composite fabric of the liner 12.

Although each ply 34 and 36 is constructed from separate sheets of fabric, the entire inner liner portion 32 is configured to act as a continuous sheet of the material. This is accomplished through the joining together of fabric plies 34 and 36 of appropriate size by stitching 40 with yarn made from KEVLAR material. Again, these two plies 34 and 36 are overlapped at least twelve inches. The stitching 40 or seam of successive layers will be staggered from one another by a minimum of twenty-four inches. Successive layers may be joined together via additional epoxy adhesive 38 and stitching 40. It is to be noted that the inner liner portion 32 of the liner 12 will be constructed from multiple plies 34 and 36 of the interwoven KEVLAR fabrics with the exact number of plies 34 and 36 forming the successive layers dependent on the specific application.

During construction of the inner liner portion 32, all stitch lines 40 are sealed with epoxy adhesive 38 to insure a fluid tight barrier where applicable. Other sealants may be substituted if dictated by the specific application. Fluid impermeability in the inner liner portion 32 is obtained through the selection of appropriate material fabric weave, configuration, and/or surface treatments. Should any application require additional measures to insure fluid impermeability, appropriate sealants can be applied to the inner liner portion 32. It is to be appreciated, however, that the synthetic rubber top and bottom side layers 42 and 44 which encase the inner liner portion 32 are impermeable to all fluids and chemicals.

In operation, the liner 12 provides a fluid, air, and petroleum fight barrier between the contents and the hull 16 of the vessel V. Should the hull 16 of the vessel V be breached or punctured, the liner 12 will absorb the force associated with the loss of containment integrity and, by virtue of its own physical properties, retain its own integrity in the process.

Figure 7:
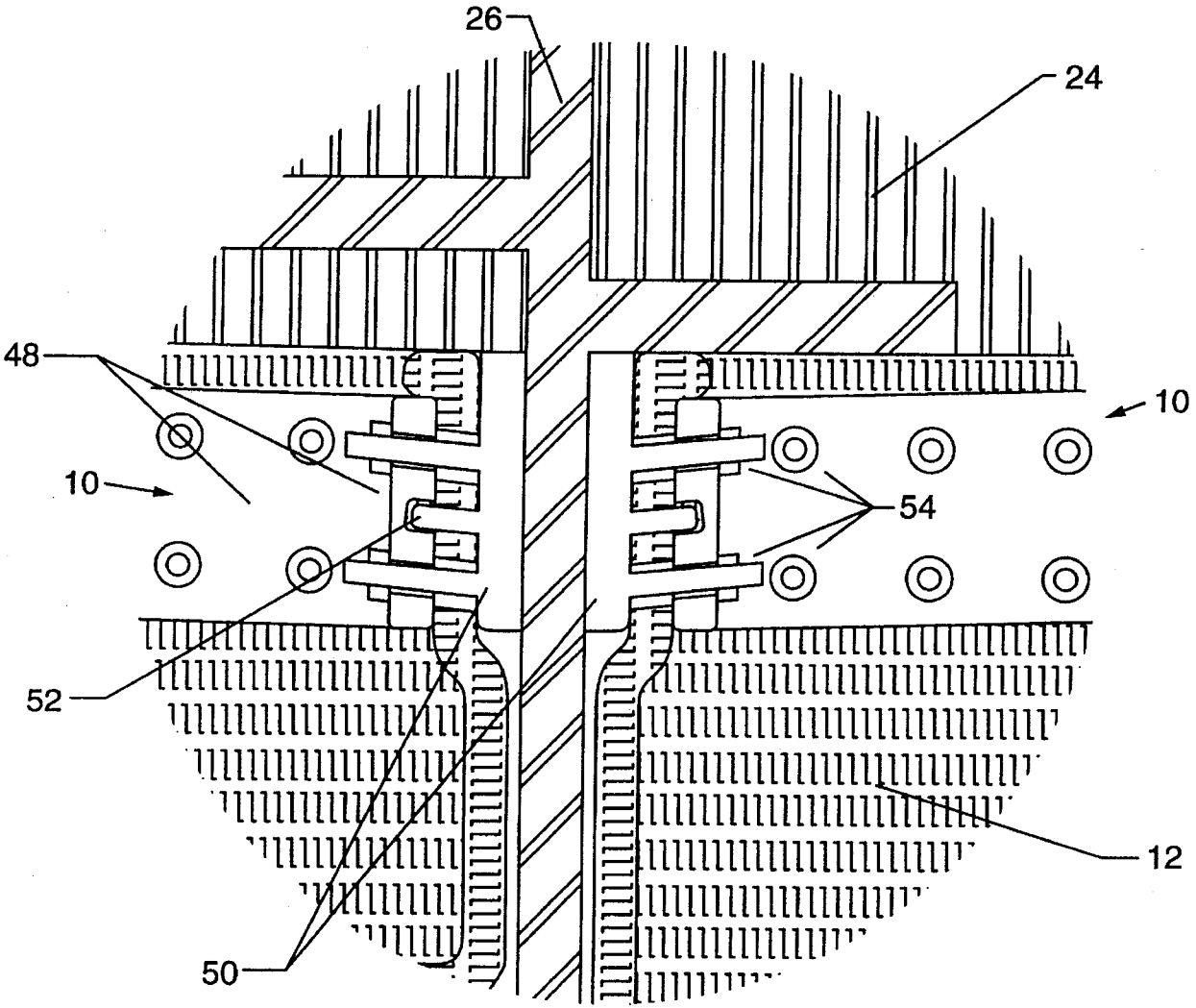
FIG. 7 is an enlarged front view of the fastener system which rigidly secures the containment integrity system of FIG. 1 to the vessel.

FIG. 7 depicts a detailed view of the fastening system 10 of the containment integrity system. As seen in FIG. 1, the fastening system 10 attaches the liner 12 to the walls of the bulkheads 24 and 26 some distance up on the walls. The exact location and orientation of the fastening system 10 depends on the specific vessel V or storage tank to which the liner 12 is being secured. In some instances, the fastening system 10 can be attached to the very top of the vessel V or storage tank. As seen in FIG. 1, however, the fastening system 10 attaches the liner 12 to the bulkheads 24 and 26 just under the existing structural members which span the center cargo tank 22 and the wing cargo tanks 20.

As seen in FIG. 7, fastening of the liner 12 to the vessel V begins as the liner 12 is suspended from a number of threaded studs 54 and center dowels 52 which protrude outward and slightly upward from a number of back plates 50 rigidly secured to the bulkheads 24 and 26. Once the liner 12 is in position, a number of mating cover plates 48 are placed over the threaded studs 54 and center dowels 52 and into contact with the face of the liner 12.. The cover plates 48 are then securely fastened to the liner 12 and back plates 50 with a number of nuts which are tightened over the threaded studs 54, thereby plating the portion of the liner 12 in between the cover plates 48 and the back plates 50 in compression. The center dowels 52 protruding from the back plates 50 rest in recesses in the rear sides of the cover plates 48, thereby providing an additional locking mechanism. Having the liner 12 placed in compression and locked in between the cover plates 48 and the back plates 50 insures that the liner 12 will remain intact and in position if and when there is a loss of containment integrity in the vessel V which leads to an applied stress on the liner 12.

Figure 8:
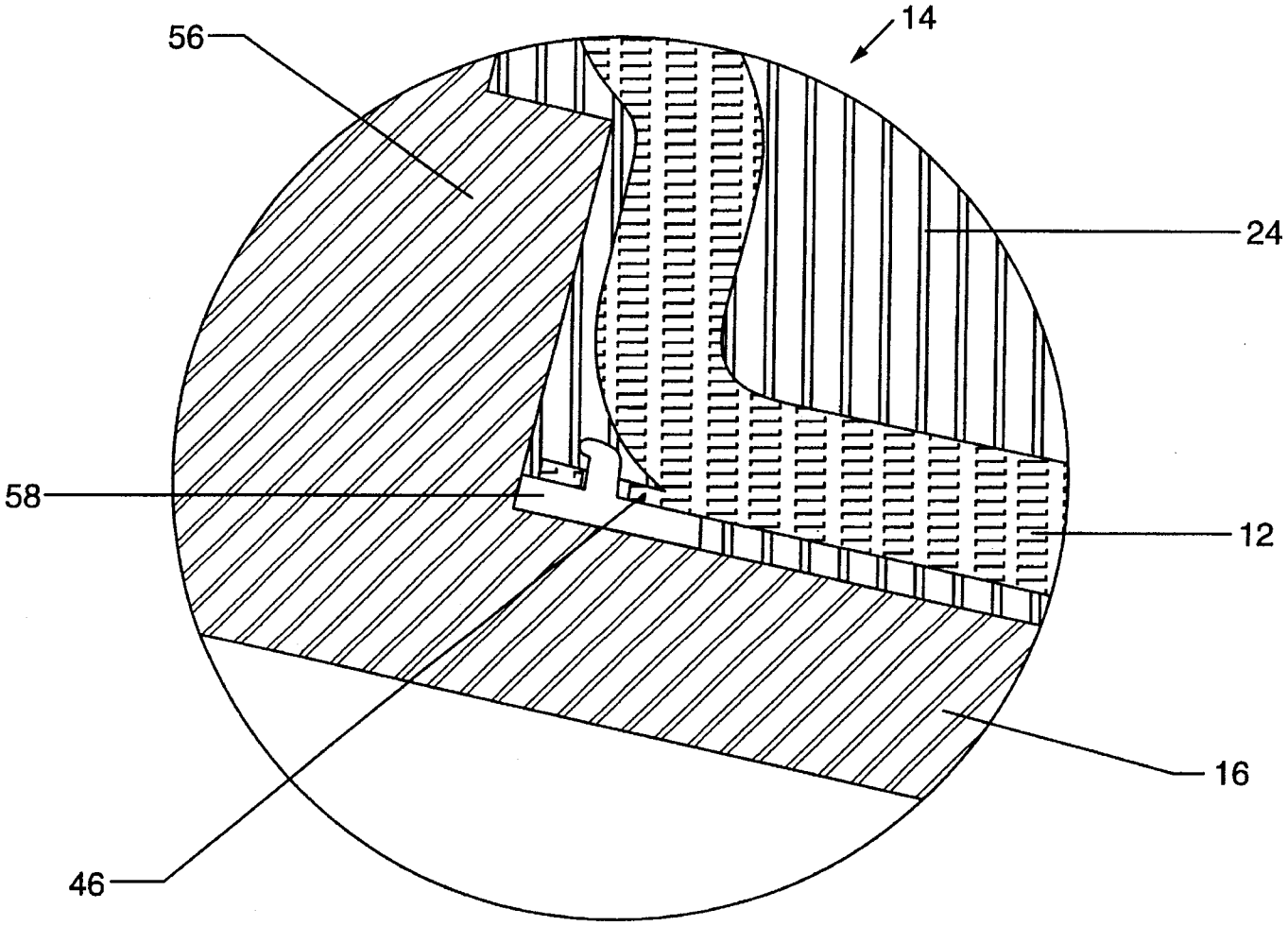
FIG. 8 is an enlarged view of the anchoring system which releasably attaches the containment integrity system of FIG. 1 to various topographical features of the vessel.

The anchoring system 14 proposed by the present invention, shown in FIG. 8, ensures conformity of the liner 12 over coverable features of the vessel V. These coverable features may include ribs protruding from the hull 16 or other physical obstructions attached to the hull 16 or bulkheads 24 and 26. Conforming the liner 12 to all coverable features of the vessel V ensures that a minimum of cargo volume is taken by the liner 12 itself.

As seen in FIG. 8, a portion of the liner 12 is to be conformed around a section of the hull 16 of the vessel V and a structural member 56 stemming from the hull. This is accomplished by attaching the tear away tabs 46 of the liner 12 to anchoring strips 58 connected to the hull 16 of the vessel V. The tear away tabs 46 hold this portion of the liner 12 to the contour of the hull 16 and structural member 56 via the anchoring strips 58 under all normal operating conditions of content filling, transporting, and emptying. However, since the tear away tabs 46 are made from non-reinforced rubber, they are designed to rip away from the anchoring strips 58 when an external object or an external force breaches the hull 16 of the vessel V. In this sense, the flexible liner 12 will readily detach from the hull 16 and move with the protruding object (after it has punctured the hull 16) while, by virtue of its physical properties, retain its own containment integrity and keep the contents of the vessel V safely and securely stored within.

The fastening system 10 and anchoring system 14 for securing the flexible liner 12 provides an ease of installation not readily available in other alternative methods. This system requires a minimum amount of specialized equipment, skills, and time to implement as compared to alternative methods.

As the structural design of many vessels V dictates that their cargo volume be divided into numerous compartments via transverse and longitudinal bulkheads 24 and 26, a number of flow holes 30 are provided in between these compartments in order to facilitate content filling and emptying. During normal operation of the vessel V, the liquid petroleum material is free to mix and flow between different compartments through these flow holes 30. .Simply covering all sections of the compartments with the liner 12 (including the flow holes 30) would preclude the mixing and flowing of the liquid contents in between the compartments. It is, therefore, necessary to provide apertures in the liner 12 of the present invention which match the flow holes 30 and thereby allow the contents to mix and flow between compartments. However, it has been discovered that if a self-sealing flange assembly is placed in each flow hole 30 connecting two compartments, an additional element of security and safety may be applied to the present containment integrity system.

Figure 9A:
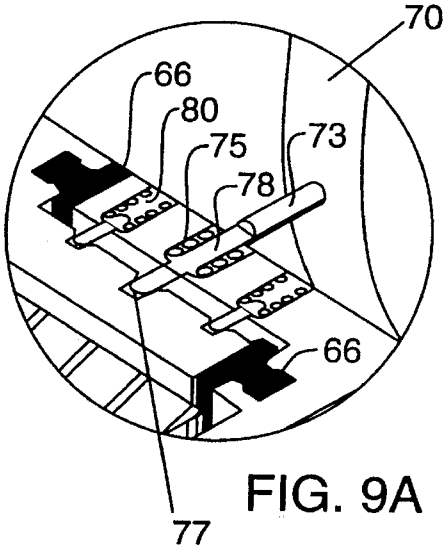
FIG. 9A is an enlarged view of a portion of the self-sealing flange assembly of FIG. 9.
Figure 9:
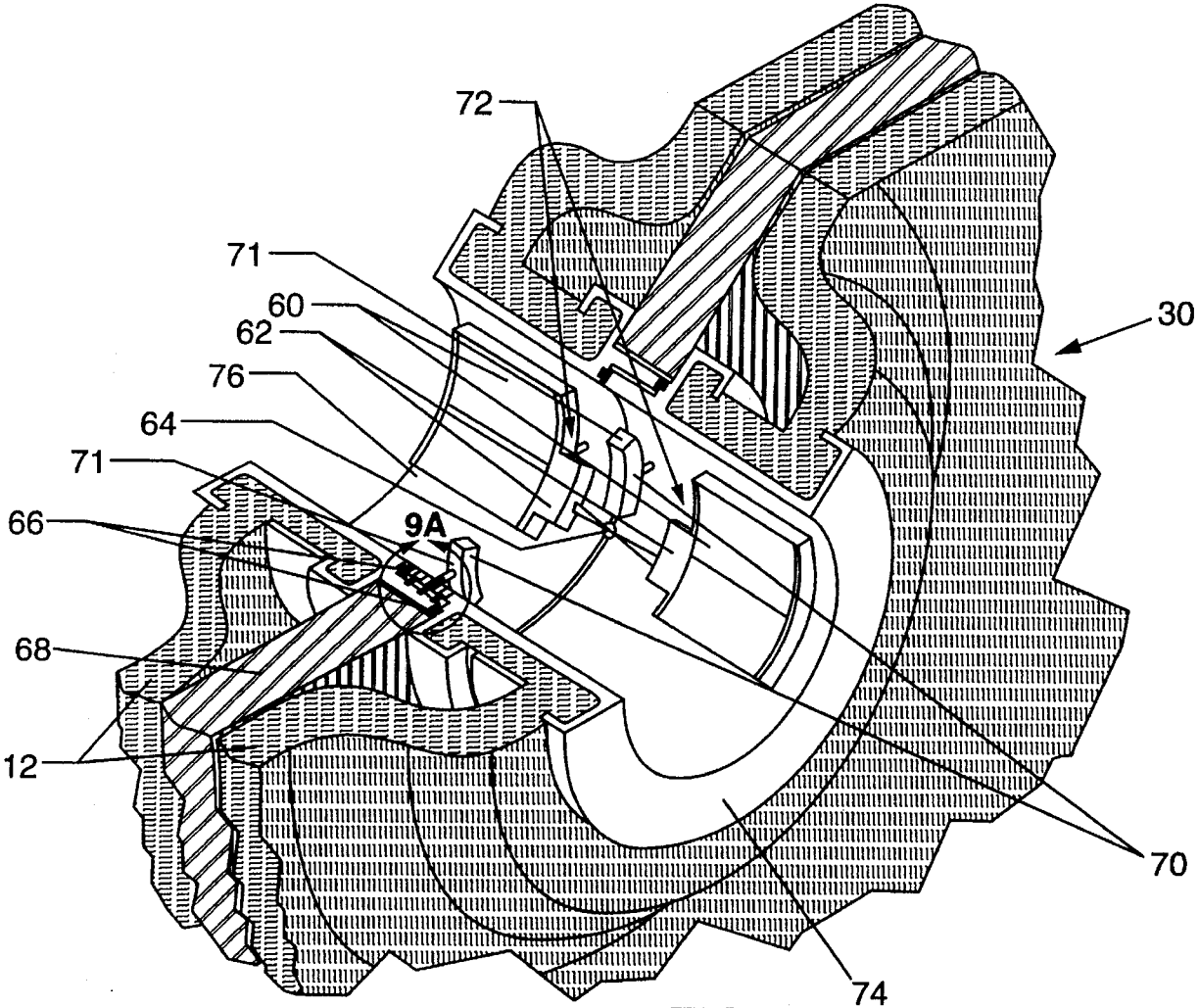
FIG. 9 is a perspective view, much enlarged, of a self-sealing flange assembly for use in the flow holes connecting the various cargo compartments in the vessel of FIG. 1.

FIGS. 9 and 9A give a perspective view of a self-sealing flange assembly which has been installed in the flow hole 30 of a steel bulkhead 68 connecting two compartments such as the center cargo tank 22 and one of the wing cargo tanks 20. The flange assembly has a first half 74 and a second half 76, the two halves 74 and 76 connected together via two locking pin assemblies 70 with handles 71 for removal. Each of the two flange assembly halves 74 and 76 are fitted about a round, open portion of the liner 12. The connection of the two flange assembly halves 74 and 76 is sealed with two O-ring seals 66.

Installation of the flange assembly includes fitting the first half 74 of the flange assembly into the second half 76, the latter already being positioned in the flow hole 30. In order to do this, the handles 71 of the two locking pin assemblies 70 provided on the first half 74 of the flange assembly must be pulled open. This opposes the normally closed or compressive position of the locking pin assembly 70 afforded by the primary pin and spring mechanism 78. That is, when the handle 71 of the locking pin assembly 70 is pulled out, the pin 73 of the primary pin and spring assembly 78 is also pulled out, thereby compressing the spring 75. When the first half 74 of the flange assembly has been slid into the recess provided in the second half 76 of the flange assembly, the handles on the locking pin assemblies 70 are released in order to allow the primary pin and spring mechanism 78 to urge the pin portions 73 of the two locking pin assemblies 70 into their respective slots 77 provided in the second half 76 of the flange assembly. The primary pin and spring mechanism 78 together with a number of secondary pin and spring mechanisms 80 keep the two flange halves 74 and 76 together under all normal operating conditions of content filling, transporting, and emptying.

Figure 10:
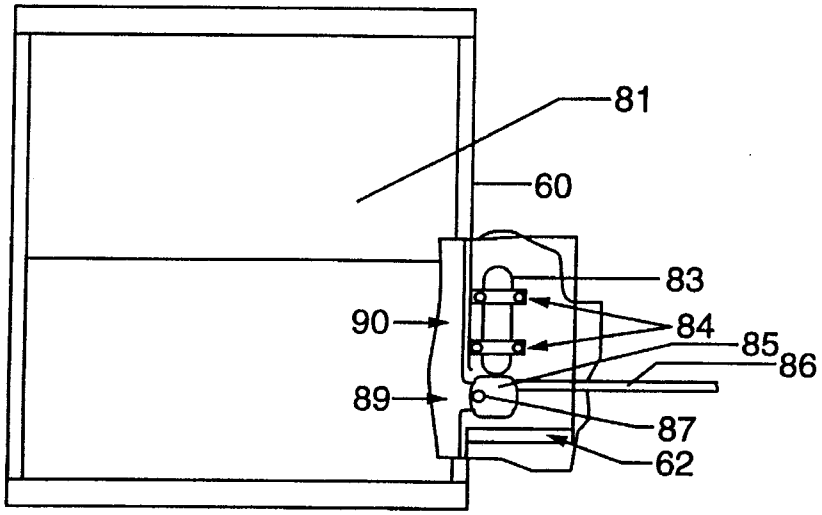
FIG. 10 is a top perspective view of the gas bag assembly of FIG. 9, with an enlarged view of the trigger mechanism.
Figure 11A:
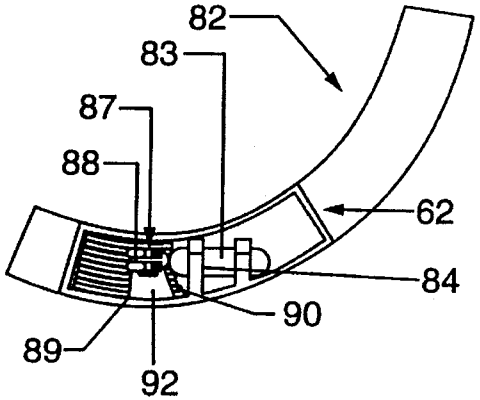
FIG. 11A is a cross-sectional view of the gas bag assembly along line AA of FIG. 11.
Figure 11:
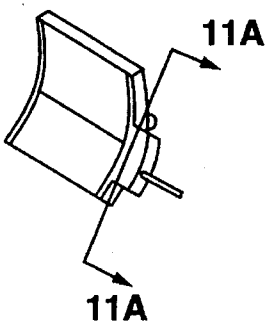
FIG. 11 is a perspective view of the gas bag assembly of FIG. 10.

However, when one cargo compartment has its hull 16 breached by an external object, a shearing type of stress resulting from the additional pressure in the liner 12 is applied to the self-sealing flange assemblies provided in the flow holes 30 of the compartment where loss of the containment integrity of the hull 16 has occurred. In response to this shearing stress caused by the rupture of the hull 16, the locking pin assemblies 70 disengage and allow the two halves 74 and 76 of the flange assemblies to separate. The gas bag assembly shown in FIGS. 10, 11 and 11A is positioned on each half of the self sealing flange assembly. The gas bag assembly is formed of a gas bag housing 60 which contains a folded gas bag ready for deployment 90. The gas bag 90 has a gas bag feed manifold 89 for injecting gas to fill the bag 90. The gas is provided by a gas canister 83 positioned in a gas canister housing 62 adjacent to the gas bag housing 60. The gas canister 83 is secured by gas canister mounts 84 to the gas canister housing 60. The gas bag feed manifold 89 is welded to the manifold and valve assembly 92 which is also connected to the gas canister 83.

There is a trigger 86 attached to a trigger mechanism 88. The trigger 86 is activated when the two halves 74 and 76 of the flange assembly separate. The triggers 86 from each side of the flange assembly are connected 64 at the center of the self-sealing flange assembly. When the two halves 74 and 76 of the flange assembly separate this puts pressure on the connected triggers 64. This pressure causes the trigger 86 to be pulled from the trigger assembly 85 activating the trigger mechanism 88. The trigger mechanism 88 is turned thereby activating a spring and pin assembly (not shown) which pierces the gas canister 83, releasing the gas and inflating the gas bag 90.

The gas bag 90 is inflated through the manifold and valve assembly 92 which forms the connection between the gas bag feed manifold 89 and the gas canister 89. There is a valve/manifold retaining cap 87 which holds valve/manifold in place to trigger mechanism 88. The valve/manifold retaining cap 87, the manifold and valve assembly 92, the gas bag feed manifold 89, the trigger mechanism 88 and a portion of the trigger 86 are all housed within the trigger assembly housing 85. The filled gas bag (not shown) affords a dual, balloon-type seal within each of the affected flow holes 30. In this respect, the cargo compartment or compartments which have suffered a loss of containment integrity to their respective hull portions may not only be protected by the flexible liner 12 fastened and secured therein, but may also be isolated from the remaining cargo compartments to ensure a minimum of petroleum product spillage if the unlikely rupture of the liner 12 has indeed occurred.

It is to be understood that the sealing action of the self-sealing flange assemblies is a rapid, explosive, and powerful process. Only a fraction of a second occurs between the separation of the flange halves 74 and 76 and the activation of the trigger assemblies and gas canister housings 62 which release gas filled bags. Therefore, it is necessary to provide each self-sealing flange assembly with a safety system which can preclude activation of the sealing mechanism. As seen in FIG. 9, this safety system takes the form of two cotter pins 72 placed into the two trigger assemblies and gas canister housings 62 provided on each self-sealing flange assembly. It will be appreciated that although appropriate locking mechanisms other than the cotter pins 72 illustrated may be used to deactivate the self-sealing flange assembly, some form of safety system is required to insure safety during installation, separation, and/or maintenance of the same. If in fact the trigger assemblies and gas canister housings 62 were not deactivated and if they were inadvertently triggered, any body part inside the self-sealing flange assembly at that time would be severely injured, very possibly resulting in permanent disability or death.

Using the liner system described above, it is possible to provide the necessary containment integrity of the hull 16 of the vessel V without significant reduction in volume of the vessel V. The material of the liner 12 affords, by its physical nature, sufficient guarantee of containment integrity while not requiring large bulk volume.

It should be clear that the invention is not limited to the previous descriptions and drawings, which merely illustrate the preferred embodiment. Slight departures may be made within the present scope of the invention. Therefore, the scope of the invention is meant to embrace any and all equivalent apparatus, as well as all design alterations, described in the appended claims.

What is claimed is:

1. A containment integrity system for use in a vessel used to store and/or transport bulk materials, said vessel having an arcuate hull comprising a rigid, continuous structure forming a storage portion for containing said bulk materials, said vessel having a plurality of structural bulkhead walls dividing said storage portion of said hull into numerous cargo compartments, said bulkhead walls having a multiplicity of flow holes disposed wherein for allowing circulation of said bulk material among said compartments, said containment integrity system comprising:

flexible liner means, said flexible liner means having an inner composite fabric portion and an outer synthetic rubber skin portion, said inner composite fabric portion formed from a plurality of layers of fabric woven from strands of a polymeric material, said layers of fabric constructed from a number of individual plies stitched together, said outer synthetic rubber skin portion reinforced with strands of said polymeric material, said outer synthetic rubber skin portion having a multiplicity of non-reinforced rubber extensions stemming therefrom;

fastening means for rigidly securing said flexible liner means to said bulkhead walls of said vessel, said fastening means comprising a number of joining plates, said joining plates enclosing and compressing a portion of said flexible liner means, said joining plates fastened together via a number of threaded studs and nuts;

anchoring means for releasably securing and conforming said flexible liner means to and about all coverable features of said hull, said anchoring means comprising a number of anchoring strips and said non-reinforced rubber extensions of said outer synthetic rubber skin portion of said flexible liner means, said non-reinforced rubber extensions attaching to said anchoring strips, said non-reinforced rubber extensions tearing away from said anchoring strips when a sufficient external force is applied to said flexible liner means; and self-sealing flange assembly means provided in said flow holes of said bulkhead walls, said self-sealing flange assembly means comprising two mating halves which are joined together via a number of locking pin mechanisms, said self-sealing flange assembly means further comprising a number of gas canister housings, trigger assemblies, and gas bags for sealing said flow holes in the event of loss of containment integrity of said hull of said vessel.

2. A containment integrity system for use in a vessel used to store and/or transport bulk materials as recited in claim 1, wherein said polymeric material forming said strands which are woven together to form said plies of said inner composite fabric portion is at least 89% Poly terephthaloylchloride p-phenylenediamine.

3. A containment integrity system for use in a vessel used to store and/or transport bulk materials as recited in claim 1, wherein said outer synthetic rubber skin portion has a top layer and a bottom layer, whereby said top layer is a textured synthetic rubber lamina reinforced with said strands of said polymeric material, and wherein said bottom layer is a smooth synthetic rubber lamina reinforced with said strands of said polymeric material.

4. A containment integrity system for use in a vessel used to store and/or transport bulk materials as recited in claim 1, wherein said plies are overlapped an appropriate amount before they are stitched together to form said layers, whereby stitching seams are formed along said layers, and wherein said stitching seams are staggered a sufficient distance when said layers are joined together to form said inner composite fabric portion.

5. A containment integrity system for use in a vessel used to store and/or transport bulk materials as recited in claim 4, wherein epoxy adhesive is used to seal said stitching seams and other appropriate areas of said inner composite fabric portion.

6. A containment integrity system for use in a vessel used to store and/or transport bulk materials as recited in claim 1, wherein said joining plates of said fastening means are front plates and back plates, whereby said back plates are rigidly secured to said bulkhead walls, and wherein said back plates have protruding dowels which mate into recesses provided in said front plates in order to provide an additional locking mechanism.

7. A containment integrity system for use in a vessel used to store and/or transport bulk materials as recited in claim 1, wherein said self-sealing flange assembly means further comprises a plurality of O-ring seals in between said mating halves for sealing said self-sealing flange assembly means, means for activating said gas canister housings and trigger assemblies, a number of primary and secondary pin and spring assemblies for holding said mating halves of said self-sealing flange assembly means together during normal operation of said vessel, and a safety system locking said gas canister housings and trigger assemblies and thereby preventing inadvertent activation of said self-sealing flange assembly.

8. A containment integrity system for use in a vessel used to store and/or transport bulk materials, said vessel having an arcuate hull comprising a rigid, continuous structure forming a storage portion for containing said bulk materials, said vessel having a plurality of structural bulkhead walls dividing said storage portion of said hull into numerous cargo compartments, said bulkhead walls having a multiplicity of flow holes disposed therein for allowing circulation of said bulk material among said compartments, said containment integrity system comprising:

flexible liner means, said flexible liner means having an inner composite fabric portion and an outer synthetic rubber skill portion, said inner composite fabric formed from a plurality of layers of fabric woven from strands of a polymeric material, said layers of fabric constructed from a number of individual plies stitched together, said outer synthetic rubber skin portion reinforced with strands of said polymeric material, said outer synthetic rubber portion having a multiplicity of non-reinforced rubber extensions stemming therefrom;

fastening means rigidly securing said flexible liner means to said bulkhead walls of said vessel;

anchoring means for releasably securing and conforming said flexible liner means to and about all coverable features of said hull; and self-sealing flange assembly means provided in said flow holes of said bulkhead walls, said self-sealing flange assembly means comprising two mating halves which are joined together via a number of locking pin mechanisms formed of a plurality of primary and secondary pin and spring assemblies, said self-sealing flange assembly means further comprising a number of gas canister housings and trigger assemblies which are activated by activation means, gas bags for sealing said flow holes in the event of loss of containment integrity of said hull of said vessel, O-ring seals in between said mating halves for sealing said self-sealing flange assembly means, and a safety system locking said gas canister housings and trigger assemblies and thereby preventing inadvertent activation of said self-sealing flange assembly.

9. A containment integrity system for use in a vessel used to store and/or transport bulk materials as recited in claim 8, wherein said polymeric material forming said strands which are woven together to form said plies of said inner composite fabric portion is at least 89% Poly terephthaloylchloride p-phenylenediamine.

10. A containment integrity system for use in a vessel used to store and/or transport bulk materials as recited in claim 8, wherein said outer synthetic rubber skin portion has a top layer and a bottom layer, whereby said top layer is a textured synthetic rubber lamina reinforced with said strands of said polymeric material, and wherein said bottom layer is a smooth synthetic rubber lamina reinforced with said strands of said polymeric material.

11. A containment integrity system for use in a vessel used to store and/or transport bulk materials as recited in claim 8, wherein said plies are overlapped an appropriate amount before they are stitched together to form said layers, whereby stitching seams are formed along said layers, and wherein said stitching seams are staggered a sufficient distance when said layers are joined together to form said inner composite fabric portion.

12. A containment integrity system for use in a vessel used to store and/or transport bulk materials as recited in claim 11, wherein epoxy adhesive is used to seal said stitching seams and other appropriate areas of said inner composite fabric portion.

13. A containment integrity system for use in a vessel used to store and/or transport bulk materials as recited in claim 8, wherein said fastening means comprises a number of front plates and back plates, whereby said front plates and said back plates enclose and compress a portion of said flexible liner means, wherein said front plates and said back plates fasten together via a number of threaded studs and nuts, whereby said back plates are rigidly secured to said bulkhead walls, and wherein said back plates have protruding dowels which mate into recesses provided in said front plates in order to provide an additional locking mechanism.

14. A containment integrity system for use in a vessel used to store and/or transport bulk materials as recited in claim 8, wherein said anchoring means comprises a number of anchoring strips and said non-reinforced rubber extensions of said outer synthetic rubber skin portion of said flexible liner means, and whereby said non-reinforced rubber extensions attach to said anchoring strips only to tear away therefrom when a sufficient external force is applied to said flexible liner means.

15. A containment integrity system for use in a vessel used to store and/or transport bulk materials, said vessel having an arcuate hull comprising a rigid, continuous structure forming a storage portion for containing said bulk materials, said vessel having a plurality of structural bulkhead walls dividing said storage portion of said hull into numerous cargo compartments, said bulkhead walls having a multiplicity of flow holes disposed therein for allowing circulation of said bulk material among said compartments, said containment integrity system comprising:

flexible liner means, said flexible liner means having an inner composite fabric portion and an outer synthetic rubber skin portion, said inner composite fabric portion formed from a plurality of layers of fabric woven from strands of a polymeric material, said layers of fabric constructed from a number of individual plies stitched together, said outer synthetic rubber skin portion reinforced with strands of said polymeric material, said outer synthetic rubber skin portion having a multiplicity of non-reinforced rubber extensions stemming therefrom;

fastening means for rigidly securing said flexible liner means to said bulkhead walls of said vessel, said fastening means comprising a number of joining plates, said joining plates enclosing and compressing a portion of said flexible liner means, said joining plates fastened together via a number of threaded studs and nuts;

anchoring means for releasably securing and conforming said flexible liner means to and about all coverable features of said hull, said anchoring means comprising a number of anchoring strips and said non-reinforced rubber extensions of said outer synthetic rubber skin portion of said flexible liner means, said non-reinforced rubber extensions attaching to said anchoring strips, said non-reinforced rubber extensions tearing away from said anchoring strips when a sufficient external force is applied to said flexible liner means; and self-sealing flange assembly means provided in said flow holes of said bulkhead walls.

16. A containment integrity system for use in a vessel used to store and/or transport bulk materials as recited in claim 15, wherein said self-sealing flange assembly means comprises two mating halves which are joined together via a number of locking pin mechanisms formed of a plurality of primary and secondary pin and spring assemblies, a number of gas canister housings and trigger assemblies which are activated by activator means, gas bags for sealing said flow holes in the event of loss of containment integrity of said hull of said vessel, O-ring seals in between said mating halves for sealing said self-sealing flange assembly means, and a safety system locking said gas canister housings and trigger assemblies and thereby preventing inadvertent activation of said self-sealing flange assembly.

17. A containment integrity system for use in a vessel used to store and/or transport bulk materials as recited in claim 15, wherein said polymeric material forming said strands which are woven together to form said plies of said inner composite fabric portion is at least 89% Poly terephthaloylchloride p-phenylenediamine.

18. A containment integrity system for use in a vessel used to store and/or transport bulk materials as recited in claim 15, wherein said outer synthetic rubber skin portion has a top layer and a bottom layer, whereby said top layer is a textured synthetic rubber lamina reinforced with said strands of said polymeric material, and wherein said bottom layer is a smooth synthetic rubber lamina reinforced with said strands of said polymeric material.

19. A containment integrity system for use in a vessel used to store and/or transport bulk materials as recited in claim 15, wherein said plies are overlapped an appropriate amount before they are stitched together to form said layers, whereby stitching seams are formed along said layers, wherein said stitching seams are staggered a sufficient distance when said layers are joined together to form said inner composite fabric portion, and whereby epoxy adhesive is used to seal said stitching seams.

20. A containment integrity system for use in a vessel used to store and/or transport bulk materials as recited in claim 15, wherein said joining plates of said fastening means are front plates and back plates, whereby said back plates are rigidly secured to said bulkhead walls, and wherein said back plates have protruding dowels which mate into recesses provided in said front plates in order to provide an additional locking mechanism.

* * * * *